United States Patent [19]

Kaita et al.

[11] Patent Number: 4,643,344

[45] Date of Patent: Feb. 17, 1987

[54] RIVET SUPPLYING APPARATUS

[75] Inventors: Hirosi Kaita; Tsuyoshi Kojima, both of Hitachi; Motoji Kawai, Toyohashi, all of Japan

[73] Assignee: Hitachi, Ltd., Tokyo, Japan

[21] Appl. No.: 723,154

[22] Filed: Apr. 15, 1985

[30] Foreign Application Priority Data

Apr. 13, 1984 [JP] Japan ..... 59-72855

[51] Int. Cl.[4] ..... B21J 15/10

[52] U.S. Cl. ..... 227/112; 221/224; 227/52

[58] Field of Search ..... 221/224, 225; 227/52, 227/103, 104, 107, 112, 139

[56] References Cited

U.S. PATENT DOCUMENTS 2,728,092 12/1955 Poupitch ..... 221/225 X
4,205,547 6/1980 Yamaska ..... 227/51 X
4,267,952 5/1981 Kershner ..... 227/9
4,438,867 3/1984 Mayne et al. ..... 221/225 X
4,463,889 8/1984 Sartran ..... 227/112

*Primary Examiner*—Paul A. Bell
*Attorney, Agent, or Firm*—Antonelli, Terry & Wands

[57] ABSTRACT

An apparatus for supplying a blind rivet to a riveting device includes a rivet supplying conduit through which the rivet is supplied, a guide member to which a nose of the riveting device is moved from the workpiece, a rivet holder element for receiving the rivet, and a piston-cylinder unit for transporting the rivet holder element. The piston-cylinder unit operates to transport the rivet holder element from a position in which the rivet from the supplying conduit is received in the holder element to a position in which the nose of the riveting device approaches the holder element and holds a mandrel of the rivet.

8 Claims, 10 Drawing Figures

RIVET SUPPLYING APPARATUS

BACKGROUND OF THE INVENTION

The present invention relates to a rivet supplying apparatus, and more particularly to a rivet supplying apparatus for supplying a blind rivet to a riveting device from a rivet feeder.

A rivet feeder is known in which the rivets are fed one by one in an orientated manner. The rivet from the rivet feeder is manually set into the nose of a riveting device, e.g. a handy rivet gun or an air rivet gun. Such manual operation, however, is one of the main factors which prevent the improvement of the efficiency in the riveting work.

Accordingly, various proposals have been made to eliminate the manual rivet supplying operation from the riveting work. For example, in an automatic rivet supplying apparatus as disclosed in the Japanese Utility Model Laid-open Publication No. 146181/78, the nose of riveting device is so disposed with respect to the supplying apparatus that the axis of the nose of the riveting device aligns with the axis of one end portion of a rivet supplying conduit. The nose of the riveting device urges guide means towards a limit switch for permitting the rivet supplying. The above mentioned rivet supplying apparatus can supply rivets sequentially to the riveting device nose without manual operation. However, since the mandrel of the rivet leads the rivet body within the supplying passage in the apparatus, the rivet may be caught in the supplying passage. Accordingly the riveting work is often interrupted to re-set or remove the caught rivet from the supplying passage.

Furthermore, the positioning of the rivet relative to the nose of the riveting device is conducted via the mandrel of the rivet. In order to supply the rivets having various sizes to the riveting device, it is necessary to prepare some separate apparatus appropriate to the respective rivet sizes (i.e., mandrel sizes), or to prepare some replaceable or detachable guide means for the respective rivet sizes. Such replacement, however, also interrupts the riveting operation with the result that the efficiency of the riveting work is further degraded.

Moreover, the spring coils are used for rivet guidance which may change with passage of time, so that periodic inspection and maintenance must be required.

SUMMARY OF THE INVENTION

Accordingly, an object of the present invention is to provide a rivet supplying apparatus which has a lower possibility of occurence of a rivet clog.

Another object of the invention is to provide a rivet supplying apparatus having a shorter MTTR (Mean Time To Repair) and a longer MTBF (Mean Time Between Failures).

The above and other objects and features of the invention will be apparent from the following description of the preferred embodiments in connection with the accompany drawings.

DETAILED DESCRIPTION OF THE PREFERRED EMBODIMENTS

Figure 1:
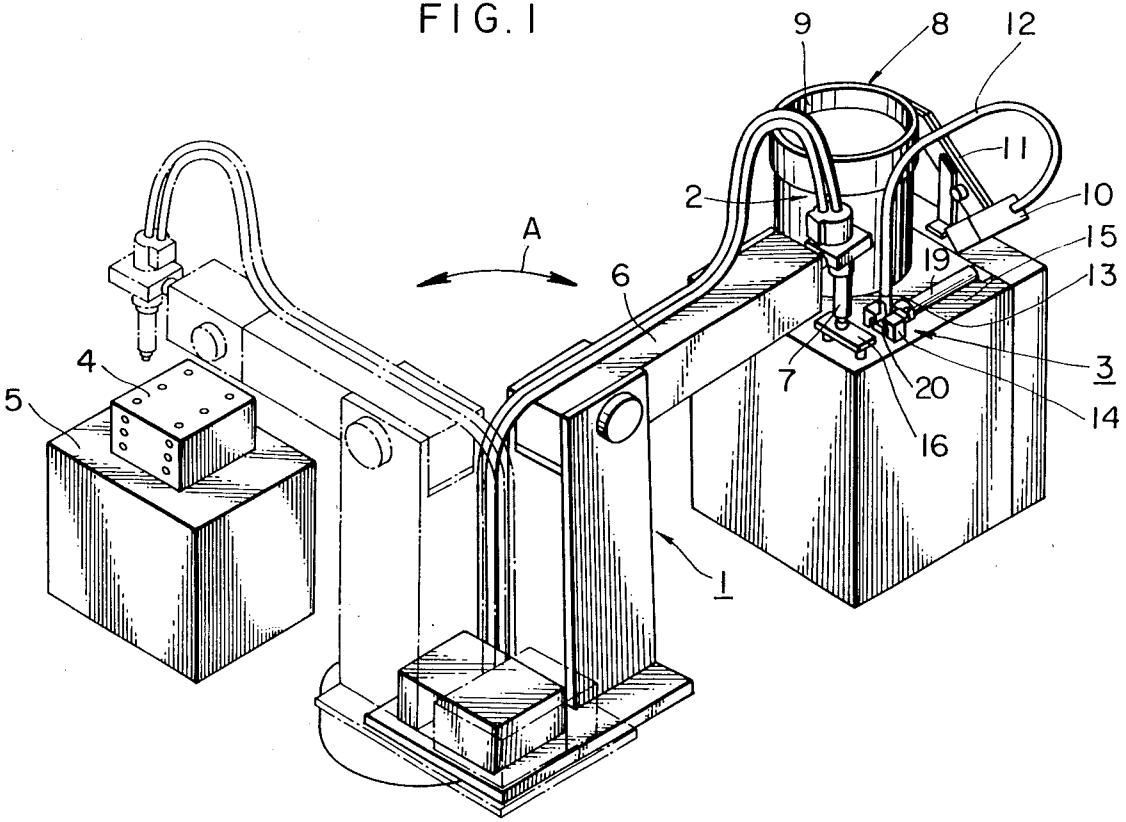
FIG. 1 is a perspective view showing a riveting robot system to which an embodiment according to the invention is applied.

Referring first to FIG. 1, a robot 1 operates to transport a riveting machine 2 between a rivet supplying apparatus 3 according to the invention and a workpiece 4 on a table 5. The robot 1 includes a swingable arm 6 which is provided at the distal end thereof with the riveting machine 2. A nose 7 of the riveting machine 2 holds a blind rivet from the rivet supplying apparatus 3 and thereafter is transported to a space above the workpiece 4 by means of the swing motion of the arm 6 (Arrow A). The riveting machine 2 is moved downwardly to insert the rivet into the rivet hole formed in the work 4 to be riveted and conducts the riveting operation. The term "blind rivet" appearing throughout the present application refers to a rivet having a hollow body, and a mandrel which extends through the hollow body and one end of which is enlarged. In the riveting work, a rivet head is urged onto the hole formed in the elements to be riveted and the other end portion of the mandrel of the rivet is pulled until the mandrel is broken. Accordingly, one end portion of the rivet body opposite to the rivet head is deformed by the enlarged end of the mandrel, so that the elements are joined together between the rivet head and the deformed end portion.

The rivets are fed from a rivet feeder 8 to the rivet supplying apparatus 3 in an orientated manner so that the rivet body leads the rivet mandrel. The rivet feeder 8 includes a container 9 for containing the mandrel type blind rivets, escapement 10, and a passage 11 through which the orientated rivets pass from the container to the escapement 10.

The rivets from the escapement 10 of the rivet feeder 8 pass through a rivet supplying conduit 12, i.e. air shooter. The conduit 12 is connected at one end thereof to the escapement 10 and the other end portion 13 of the conduit 12 remains stationary relative to a base 15 through an attachment 14 fixed to the base 15.

Figure 2:
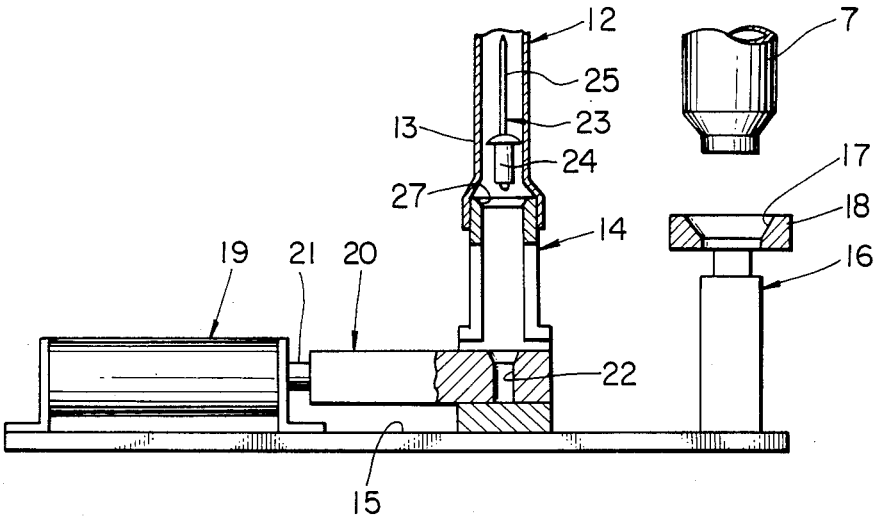
FIGS. 2 to 5 are fragmentary sectional views each showing a step of the rivet supplying operation.

As will be clearly seen from FIGS. 1 and 2, a gate shaped guide member 16 adjacent to the attachment 14 is fixed to the base 15. The nose 7 of the riveting machine 2 is first moved downwardly, along an approach line parallel to an axis of the end portion 13 of the conduit 12, to approach a hole 17 formed in a cross bar 18 of the guide member 16. There is a piston-cylinder unit 19 on the base 15, which operates to reciprocate a rivet holder element 20 attached to a piston 21 of the unit 19. The rivet holder element 20 is provided with a hole 22. The piston-cylinder unit 19 operates to reciprocate the rivet holder element 20 along a drive line perpendicular to the axis of the end portion 13 of the conduit 12 so that an axis of the hole 22 aligns with the axis of the end portion 13 of the conduit 12 as well as with the nose approach line.

The operation of the above mentioned supplying apparatus will be described hereinunder with referring to FIGS. 2 to 5. The blind rivet 23 has a body 24 and a mandrel 25. The rivet 23 is supplied in the conduit 12 one by one by means of the pneumatic pressure so that the rivet body 24 leads the mandrel 25. The rivet 23 from the conduit 12 is received at the rivet body 24 in the hole 22 of the rivet holder element 20 through a communication opening 27 formed in the attachment 14

Figure 3:
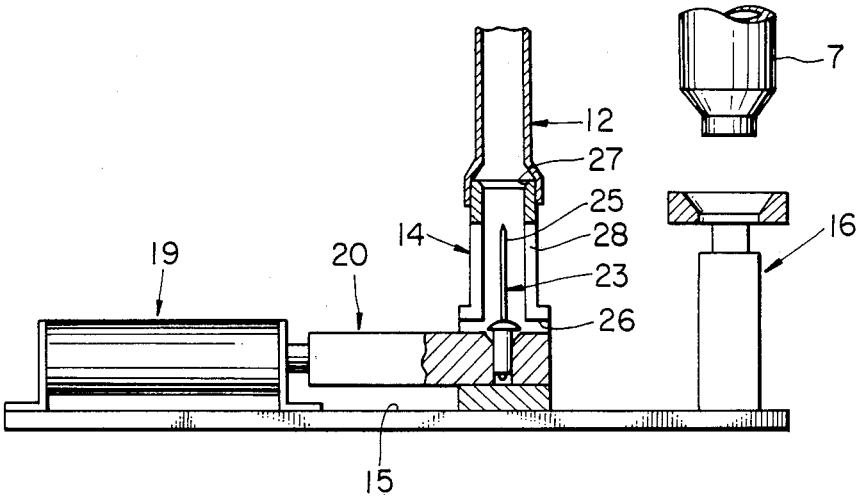
Figure 4:
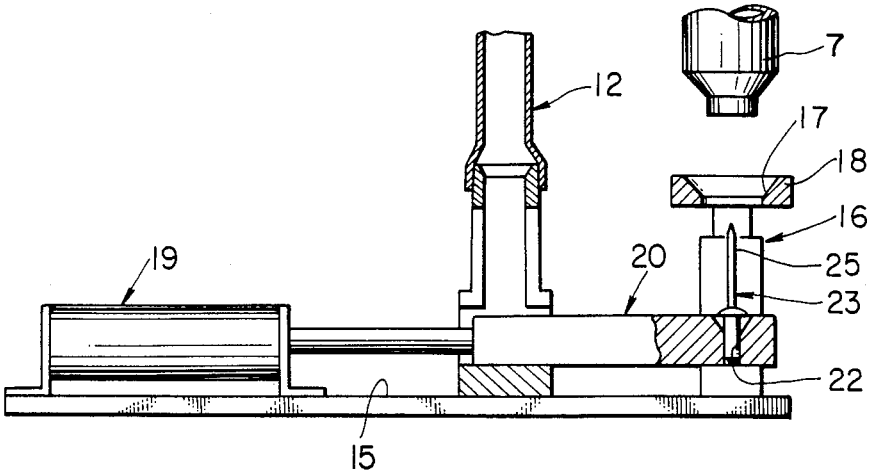

(FIG. 3). When the photo-sensor (not shown) detects safe receipt of the rivet on the hole 22, a control unit (not shown) operates to drive the piston-cylinder unit 19 to transport the rivet holder element 20 along the drive line through an opening 26 of the attachment 14. The attachment 14 is provided with a slit 28 through which the rivet mandrel 25 passes. At the moment the axis of the hole 22 of the rivet holder element 20 aligns with the approach line of the nose 7 during the transportation, i.e. a chuck of the nose 7 aligns with the mandrel 25 of the rivet 23, another photo-sensor (not shown) detects such alignment and delivers a signal to the control unit. The control unit operates to stop the piston-cylinder unit 19 from driving upon receipt of the signal from the photo-sensor (FIG. 4).

Figure 5:
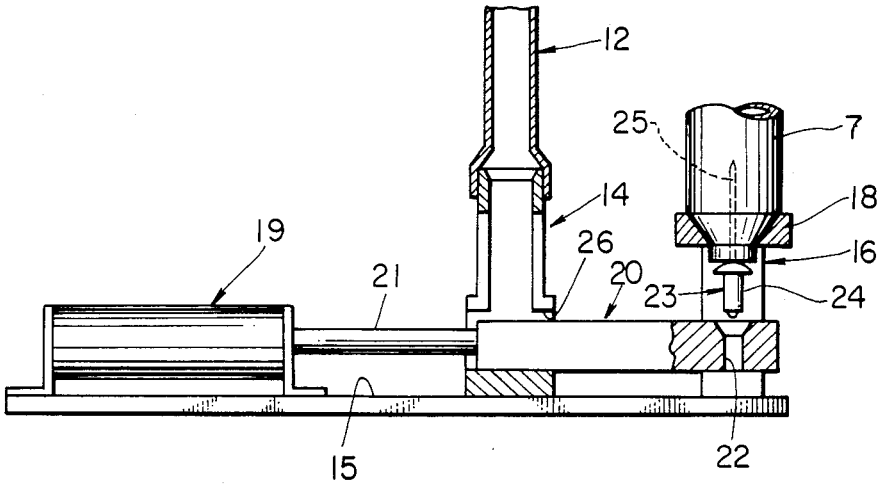

Sequentially, the nose 7 moves downwardly to the mandrel 25 of the rivet 23 along the approach line through the hole 17 in the guide member 16 and holds the mandrel 25 (FIG. 5). A negative pressure may be applied to the nose 7. If a safe holding of the mandrel 25 of the rivet 23 is once detected, the nose 7 is moved upwardly and transported towards the workpiece 4 (FIG. 1). Simultaneously, the piston-cylinder unit 19 operates to pull back the rivet holder element 20 to an original position in order to receive a new rivet (FIG. 2). The above process is repeated.

Figure 6:
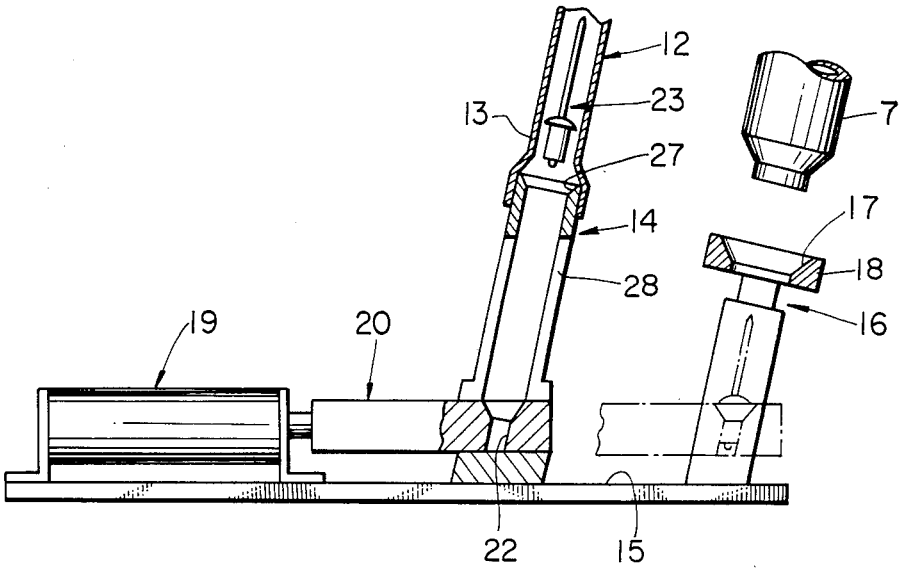
FIGS. 6 to 10 are fragmentary sectional views each showing different embodiments according to the invention, respectively.
Figure 7:
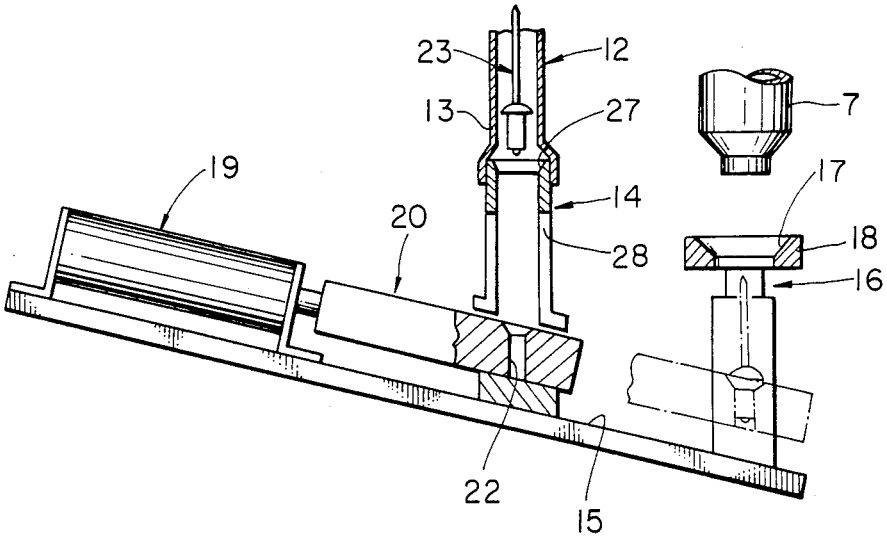

FIGS. 6 and 7 show the second and the third embodiments of the invention. In the following description of the embodiments taken in connection with the accompanying drawings, like parts and parts for the same purpose in the drawings are identified by the same reference numerals. In the second and the third embodiments, the drive line along which the rivet holder element 20 reciprocates is parallel to the base portion 15, but inclined to an axis of the end portion 13 of the rivet supplying conduit 12. However, the axis of the end portion 13 and the approach line are parallel to each other. The rivet holder element is so moved that an axis of the hole 22 is parallel to the approach line. The operations of these embodiments are substantially the same as that of the first embodiment.

Figure 8:
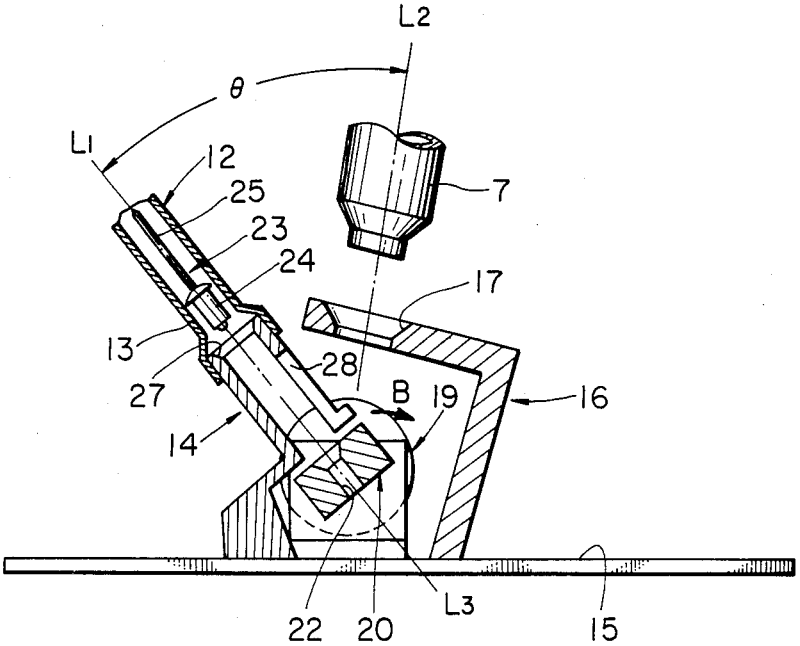

FIG. 8 shows the fourth embodiment of the invention. In this embodiment, the attachment 14 and the guide member 16 are spaced laterally from each other. The attachment 14 and the guide member 16 are so fixed on the base portion 15 that the axis $L_1$ of the end portion 13 of the conduit 12 and the approach line $L_2$ of the nose 7 are spaced at an angle $\theta$ from each other.

The operation of the rivet supplying apparatus shown in FIG. 8 will be described hereinunder. The rivet 33 is supplied within the conduit 12 by means of the pneumatic pressure. The rivet 23 from the end portion 13 is received at the body 24 thereof in the hole 22 of the rivet holder element 20 through the opening 27 of the attachment 14. When safe receipt of the rivet body 24 on the hole 22 is detected, the rivet holder element 20 is so rotated about an axis of the piston 21 in a direction of the arrow B by an angle $\theta$ by means of the piston-cylinder unit 19 that the axis $L_3$ of the hole 22 of the rivet holder element 20 becomes parallel to the approach line $L_2$ of the nose 7. Sequentially the piston 21 is driven axially to pull the rivet holder element 20 so as to make the axis $L_3$ of the hole 22 align with the approach line $L_2$ of the nose 7. When the alignment between the axis $L_3$ and the approach line $L_2$ is detected, the nose 7 is moved downwardly, along the approach line $L_2$ through the hole 17 formed in a free arm of L-shaped guide member 16, to the rivet 23 and holds the mandrel 25 thereof. After the holding of the mandrel of the rivet, the nose 7 is moved upwardly and then is transported to the work. Simultaneously the piston 21 is inversely axially driven to push the rivet holder element 20 and is driven to rotate the rivet holder element 20 conter-clockwise by the angle $\theta$ so as to make the axis $L_3$ align with the axis of $L_1$ in order to receive a new rivet.

Figure 9:
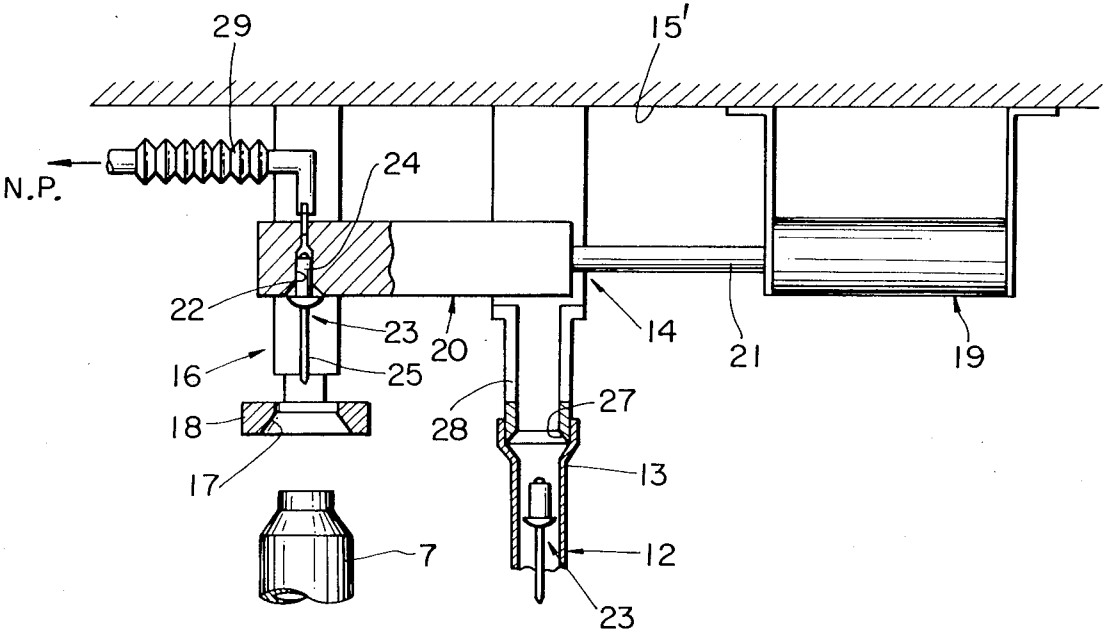

FIG. 9 shows the fifth embodiment of the present invention. In this embodiment, the piston-cylinder unit 19 is fixed on a ceiling 15'. The attachment 14 and the guide member 16 are also fixed on the ceiling 15'.

The operation of the embodiment shown in FIG. 9 wll be described hereinunder. The rivet 23 is thrust upwardly within the conduit 12 by means of the pneumatic pressure. The rivet 23 is sucked up and received at the body 24 thereof in the recess 22 formed in the rivet holder element 20 by means of the negative pressure which is applied to a bottom of the recess 22 through a flexible tube 29. When the safe receipt of the rivet 23 in the recess 22 is detected, the piston-cylinder unit 19 is driven to transport the rivet holder element 20 towards the guide member 16 so that the axis of the recess 22, i.e. the mandrel 25 of the rivet 23, aligns with the approach line of the nose 7, i.e. the chuck of the nose 7. When the alignment between the axis of the recess 22 and the approach line of the nose 7 is detected, the nose 7 is moved upwardly to approach the rivet mandrel 25 through the hole 17 in the guide member 16. Simultaneously, the application of negative pressure to the recess 22 is suspended and the nose 7 holds the mandrel 25. Sequentially the nose 7 is transported towards the workpiece. To the contrary, the piston-cylinder unit 19 operates to pull back the rivet holder element 20 so that the axis of the recess 22 aligns with the axis of the end portion 13 of the conduit 12. Sequentially the negative pressure is applied to the recess 22 again and then the preparation for receiving a new rivet is completed.

Figure 10:
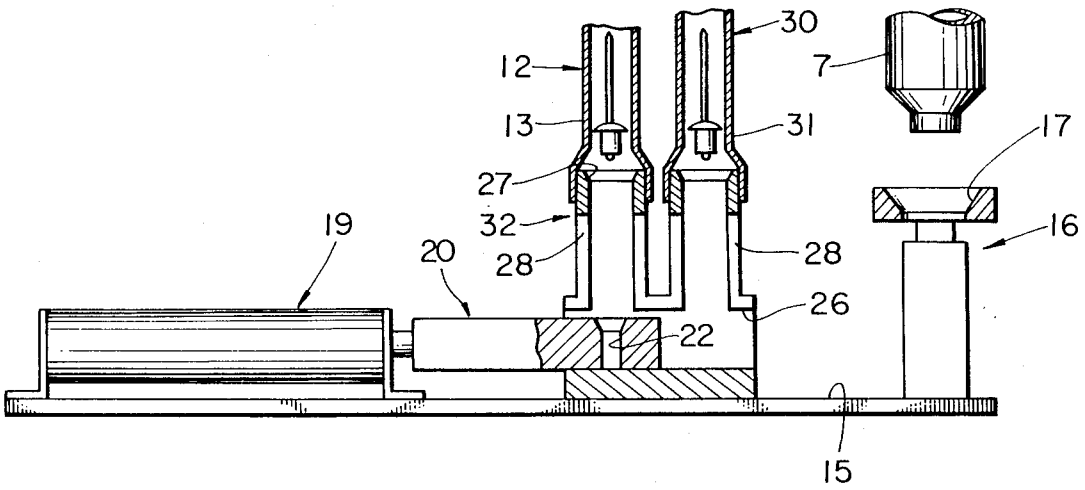

FIG. 10 shows the sixth embodiment of the present invention. In this embodiment, two rivet supplying conduits 12 and 30 remain stationary relative to the base portion 15 via the attachment 32. The piston-cylinder unit 19 is so controlled that the rivet holder element 20 can receive the rivet from the selected conduit 12 or 30. The operation of the apparatus is substantially the same as the one of the first embodiment. Rivets of a different size may pass through the conduits 12 and 30, respectively. The rivet holder element 20 can be provided with a plurality of holes the number of which corresponds with the number of the conduits. Furthermore, three or more conduits may be provided in the apparatus.

In compliance with the demands for the mounting location, the mounting condition, or the required operation of the apparatus, it is possible to select an appropriate embodiment among the above mentioned ones. In the above mentioned embodiments except the fifth embodiment, it is possible to apply the negative pressure to the hole 22 of the rivet holder element 20 so as to receive the rivet more surely, if necessary.

As described above, the process of rivet supplying can be conducted under sequence control using the sensing means and the control unit. To the contrary, it is possible to conduct the process of rivet supplying manually step by step.

What is claimed is:

1. A rivet supplying apparatus for supplying a blind rivet having a body and a mandrel extending outwards therefrom from a rivet feeder which feeds the blind rivets sequentially one by one in an orientated manner to an access position to which a nose of a riveting device is movable from a rivet working position spaced from said apparatus, said apparatus comprising:

a base;

a rivet supplying conduit through which the rivets are supplied, said conduit being connected at one end portion thereof to said rivet feed to receive rivets therefrom, and said conduit being disposed at the other end portion thereof at a fixed receiving position;

guide means supported on said base and through which said nose of said riveting device approaches said access position along an approach line during movement from said rivet working position;

a rivet holder element having recess means for receiving the body of said blind rivet from said rivet supplying conduit in said receiving position; and driving means, including a cylinder and an associated piston rod to which said rivet holder element is connected, for reciprocating said rivet holder element at least between said access postion in which an axis of said recess means aligns with an axis of said rivet supplying conduit and said receiving position in which the axis of said recess means aligns with said approach line.

2. An apparatus according to claim 1, wherein the axis of the other end portion of said rivet supplying conduit is parallel to said approach line, and wherein said driving means reciprocates said rivet holder element along a drive line substantially perpendicular to the axis of the other end portion of said rivet supplying conduit.

3. An apparatus according to claim 1, wherein the axis of the other end portion of said rivet supplying conduit and said approach line are spaced at an angle to each other, and wherein said driving means reciprocates said rivet holder means along a drive line substantially perpendicular to the axis of the other end portion of said rivet supplying conduit and rotates said rivet holder means above said drive line.

4. An apparatus according to claim 1, wherein a negative pressure is applied to said recess means.

5. An apparatus according to claim 1, wherein said apparatus further comprises at least one additional rivet supplying conduit for supplying the rivets sequentially in an orientated manner, said additional rivet supplying conduit being connected at one end thereof to said rivet feeder, the other end portion thereof being stationary relative to said base portion, and wherein said driving means transports said rivet holder means to a position in which the axis of the other end portion of said additional rivet supplying conduit aligns with the axis of said recess means.

6. An apparatus according to claim 5, wherein each of the rivet supplying conduits has a size which is appropriate for a rivet which is different in the size from the rivets which are supplied within other rivet supplying conduits.

7. An apparatus according to claim 1, wherein the axis of the other end portion of said rivet supplying conduit and said approach line are spaced at an angle to each other, and wherein said driving means reciprocates said rivet holder means along a drive line inclined to the axis of the other end portion of said rivet supplying conduit and rotates said rivet holder means about said drive line.

8. An apparatus according to claim 1, wherein the axis of the other end portion of said rivet supplying conduit and said approach line are spaced at an angle to each other, and wherein said driving means rotates said rivet holder means about a line substantially perpendicular to the axis of the other end portion of said rivet supplying conduit.

* * * * *